US006471602B1

(12) United States Patent
D'Orazio

(10) Patent No.: US 6,471,602 B1
(45) Date of Patent: Oct. 29, 2002

(54) GOLF CLUB AND HEAD THEREFOR

(76) Inventor: Michael P. D'Orazio, 181 Dunn Rd., Coventry, CT (US) 06238

( * ) Notice: Subject to any disclaimer, the term of this patent is extended or adjusted under 35 U.S.C. 154(b) by 0 days.

(21) Appl. No.: 09/317,972

(22) Filed: May 25, 1999

(51) Int. Cl.[7] ..... A63B 53/04; A63B 53/06; A63B 53/08

(52) U.S. Cl. ..... 473/324; 473/328; 473/349

(58) Field of Search ..... 473/324, 327, 473/328, 350, 345, 238, 228

(56) References Cited

U.S. PATENT DOCUMENTS

| | | | | | |
|---|---|---|---|---|---|
| 780,776 | A | | 1/1905 | Brown | |
| 837,030 | A | * | 11/1906 | Blanchard | 273/168 |
| 1,414,124 | A | | 4/1922 | Griffith | |
| 1,678,750 | A | * | 3/1928 | Swan | 273/175 |
| 2,087,685 | A | | 7/1937 | Hackney | |
| 3,059,926 | A | | 10/1962 | Johnstone | |
| 3,333,854 | A | * | 8/1967 | White | 273/164 |
| 3,468,544 | A | * | 9/1969 | Antonious | 273/173 |
| 3,819,180 | A | | 6/1974 | Murphy | |
| 4,165,076 | A | * | 8/1979 | Cella | 273/167 |
| 4,569,525 | A | * | 2/1986 | Folger | 273/81 C |
| 4,869,508 | A | * | 9/1989 | Miller | 273/175 |
| 5,000,455 | A | | 3/1991 | Beilfuss, Sr. | |
| 5,467,987 | A | * | 11/1995 | Perkins et al. | 273/175 |
| 6,080,070 | A | * | 6/2000 | Whitley | 473/340 |

* cited by examiner

*Primary Examiner*—Paul T. Sewell
*Assistant Examiner*—Sneh Varma
(74) *Attorney, Agent, or Firm*—J. Bruce Hoofnagle

(57) ABSTRACT

A golf club, such as a sand wedge 20, is formed with a head 26 having a front face 42 and a centrally located ball-impact surface 44 having a width greater than either of two passages 46 and 50 formed in the front face on each side of the ball-impact surface. A hood 72 is formed in cantilever on the head 26 and extends from an edge of the front face 42 adjacent the ball-impact surface 44 and the passages 46 and 50. A mark 80 is formed on a portion of the hood 72 and is aligned with the ball-impact surface 44, and is visible by a golfer when using the sand wedge 20. A mass 78 is formed in the head 26 to the rear of the ball-impact surface 44 on a rear face 54 of the head 26.

25 Claims, 7 Drawing Sheets

GOLF CLUB AND HEAD THEREFOR

BACKGROUND OF THE INVENTION

This invention relates to a golf club and a head therefor, and particularly relates to a sand wedge and to a head of the sand wedge.

For many years, designers of golf courses have placed bunkers, or sand traps, around the greens and along the fairways of such courses to present hazards, or challenges, to golfers in their quest to drive a golf ball from the tee to the pin in as few strokes as possible. The bunkers typically include a fine-grain, usually dry, sand. When the golf ball lands in a bunker, the granular sand presents a surface to the ball which precludes bounding of the ball in a manner which typically occurs in the clear fairways and the greens. While the ball may roll for a very short distance after landing in a bunker, it usually remains within the bunker, and slightly burrowed in the sand.

In an effort to drive the ball from its slightly burrowed position within the sand of the bunker, a golf club referred to as a sand wedge was designed some years ago. Typically, a ball-impact surface of the head of a golf club is formed at an angle with the shaft of the club, the angle being referred to as the loft. The sand wedge is a higher lofted club compared to other clubs of a typical set of clubs and is designed to launch the ball in a high, but short-travel distance, trajectory. In effect then, when used properly, the sand wedge strikes the bunkered ball along a lower side portion thereof and literally lifts the ball from the sand and launches the ball into a high trajectory and a short distance away from the bunker.

Usually, the ball-impact surface of most sand wedges presents a solid front to the bunkered ball and to the sand adjacent the ball. Consequently, the force applied by the golfer, when swinging the sand wedge to drive the ball from the bunker, must be sufficient to overcome the back force or resistance encountered when the head of the wedge is being moved into and through the sand to effect the launch of the ball.

In the past, club heads have been designed with openings which extend through the head from the ball-impact or front face to the rear face thereof to provide less resistance from the air when the club is swung, and when the head passes through obstructions such as bunkered sand and tall or marshy grass. One example of such a club head is described and illustrated in U.S. Pat. No. 780,776, which issued on Jan. 24, 1905, and where the head is formed with a plurality of spaced horizontal or vertical slots. Examples of other such club heads are disclosed in U.S. Pat. No. 1,414,124, which issued on Apr. 25, 1922, showing perforations through the head, and U.S. Pat. No. 4,869,508, which issued on Sep. 26, 1989, and U.S. Pat. No. 5,000,455, both of which also show vertical slots.

The slots and perforations of the club heads disclosed in the above-noted U.S. patents extend in closely spaced relation over essentially the entire surface of the front or ball-impact surface, including the surface area which typically engages and impacts the ball. Effectively then, there is no sizable surface area on the ball-impact surface of the heads disclosed in the above-noted U.S. patents which provide an unfettered surface with which to strike the ball.

While essentially all golfers desire to locate the so-called "sweet spot" on the ball-impact surface of the club head, and to strike the ball with the "sweet spot" each and every stroke, it is an impossibility for most golfers to accomplish because of the many variables which occur each and every time a golfer swings a club. When using clubs with slotted and perforated heads of the type described in the above-noted U.S. patents, there is little opportunity for a golfer to strike the ball cleanly with a ball-impact surface which is not occupied with a slot or a perforation. The result could be an undesirable wayward trajectory of the launched ball.

Consequently, there is a need for a club head which will provide for the passage of air, sand and/or other impediments through the head of a club being swung while, at the same time, providing a substantial solid ball-impact surface so that the ball may be fully impacted within the playing ability of the golfer.

As further illustrated in the above-noted U.S. patents, the passages of the club head are of narrow width or diameter and are formed with generally uniform wall spacing from the ball-impact surface to the rear of the head. With such small openings, and such uniform wall spacing, it is difficult for significant volumes of air, sand and other impediments to pass into and through the passages of the head. Therefore, there is a need for passages formed in and through the club head which will enhance the flow and direction of air, sand and other impediments therethrough while not interfering with impact with the ball.

When a sand wedge is used to drive a golf ball from the sand of a bunker, the club head literally lifts some of the sand from the bunker, where the sand frequently tends to rise above, and eventually falls onto, the golfer. Thus, there is a need for a club head which will deflect some of the lifted sand and direct the sand away from the golfer.

The weight of golf clubs, and the heads thereof, plays a significant part in the use of the clubs in driving a golf ball in a desired direction and trajectory. Thus, in golf clubs having passages formed through the heads thereof, there is a need for the weight of such heads to be substantially the same as the weight of a corresponding, but otherwise passageless, head.

SUMMARY OF THE INVENTION

It is, therefore, an object of the invention to provide a golf club, and a head therefor, which will provide for the passage of air and/or sand through the head of a club being swung while, at the same time, providing a substantial ball-impact surface so that the ball may be fully impacted by the head.

Another object of this invention is to provide a golf club, and head therefor, wherein passages are formed in and through the club head to enhance the flow and direction of air and/or sand through passages while not interfering with impact with the ball.

Still another object of this invention is to provide a golf club, and head therefor, which will deflect some of the sand lifted from a bunker by the swinging of the club by a golfer, and direct the sand away from the golfer.

A further object of this invention is to provide a golf club, and a head therefor, where the weight of the head, with passages therethrough, is substantially the same as the weight of a corresponding, but otherwise passageless, head.

With these and other objects in mind, this invention contemplates a golf club having a head attached to a shaft, and further contemplates the head independently of the golf club, as set forth below.

The head, as contemplated in this invention, is formed with a ball-impact surface on a front face thereof, and is further formed with a pair of spaced, opposed side edges with each side edge having a first end and a second end. The head is also formed with a first linking edge extending between the first ends of the side edges, and a second linking edge extending between the second ends of the side edges in a spaced, opposed relation to the first linking edge. An opening is formed through the head with an end of the opening located in the front face of the head, and at least a side-to-side portion of the end of the opening extends in a direction between the spaced side edges of the head at a prescribed width dimension which is equal to or greater than the width of any other side-to-side portion of the end of the opening. The ball-impact surface is solid and formed with a side-to-side portion, which extends in a direction between the spaced side edges of the head, and has a width dimension which is greater than the prescribed width dimension. The end of the opening is located between the ball-impact surface and one of the side edges of the head.

This invention further contemplates a head having a hood formed on a front face of the head which is contiguous with a plane of a ball-impact surface of the head and which extends in cantilever therefrom within a plane of a linking edge of the head. The linking edge is an edge of the head which is farthest from the ground or sand when a ball is struck by the ball-impact surface of a club being swung in the processing of launching the ball.

This invention also contemplates a head for a golf club, which includes a ball-impact surface formed on a front face of the head and an opening formed through the head from the front face to a rear face thereof. The head is composed of a prescribed material, and includes a mass of material formed on the rear face to provide a weight of the head which is substantially the same as the weight of a comparable head which is formed without the opening.

Additionally, this invention contemplates a head for a golf club, which is formed with a ball-impact surface on a front face. The head is also formed with a pair of spaced, opposed side edges with each side edge having a first end and a second end. The head is formed with a first linking edge extending between the first ends of the side edges, and a second linking edge extending between the second ends of the side edges in a spaced, opposed relation to the first linking edge. The second linking edge is an edge of the head which is fully visible to a golfer, using a club having the head attached thereto, when the golfer is aligning a ball with the ball-impact surface in preparation for launching the ball. A mark is formed on the second linking edge to facilitate locating the head for visual alignment of the ball-impact surface with the ball.

Other objects, features and advantages of the present invention will become more fully apparent from the following detailed description of the preferred embodiment, the appended claims and the accompanying drawings.

DETAILED DESCRIPTION OF THE PREFERRED EMBODIMENT OF THE INVENTION

Figure 1:
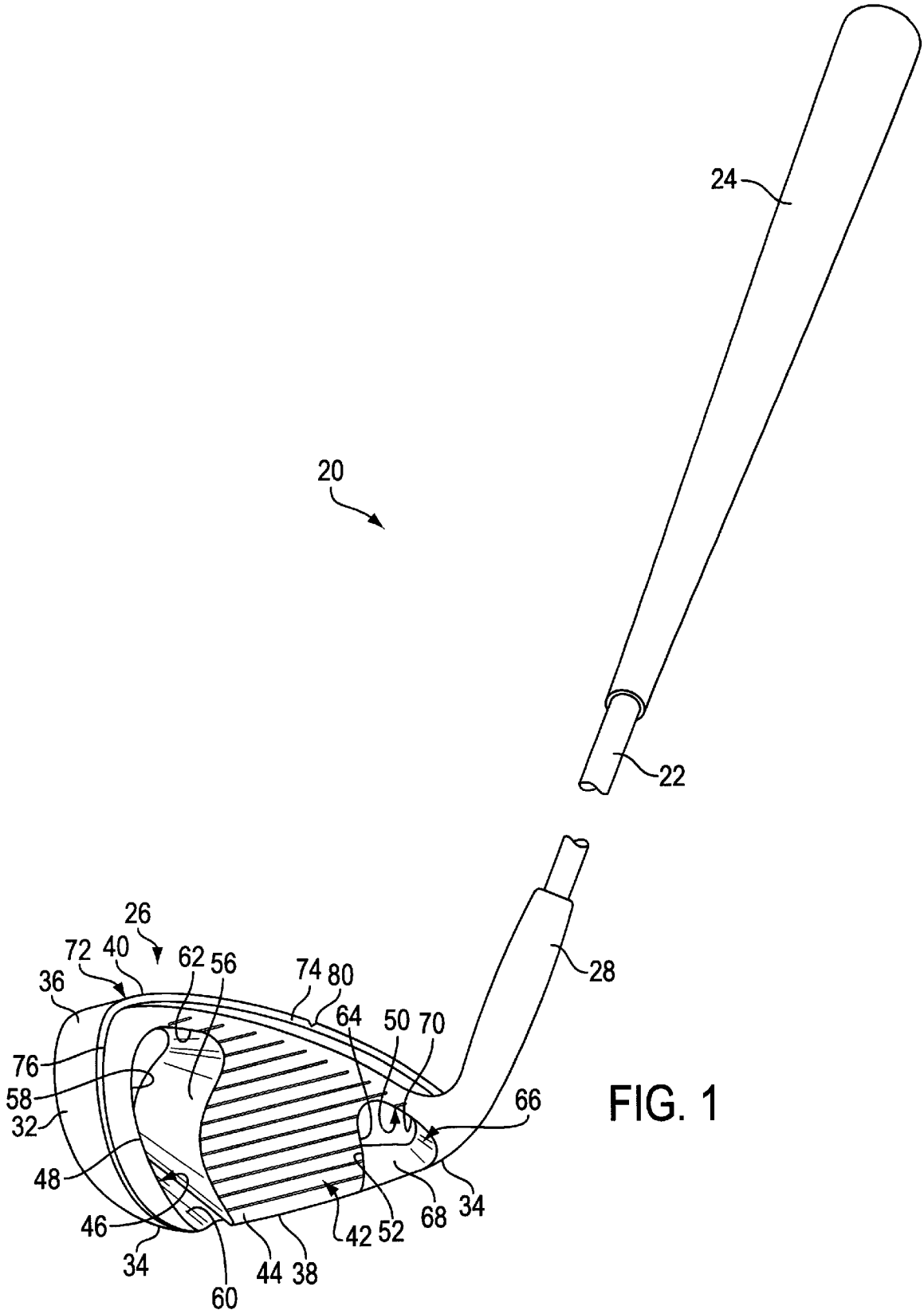
FIG. 1 is a perspective view of a golf club and a club head showing two passages through the head, contoured walls of the passages, a ball-impact surface and a sand-deflecting hood, all in accordance with certain principles of the invention.

As shown in FIG. 1, a golf club such as, for example, a sand wedge 20, includes a shaft 22, with a grip 24 at one end thereof and a head 26 at the opposite end. The head 26 is formed with a hosel 28, which extends from a side edge 30 (FIG. 3) of the head, and which provides facility for attaching the shaft 22 to the head in a conventional manner.

Figure 2:
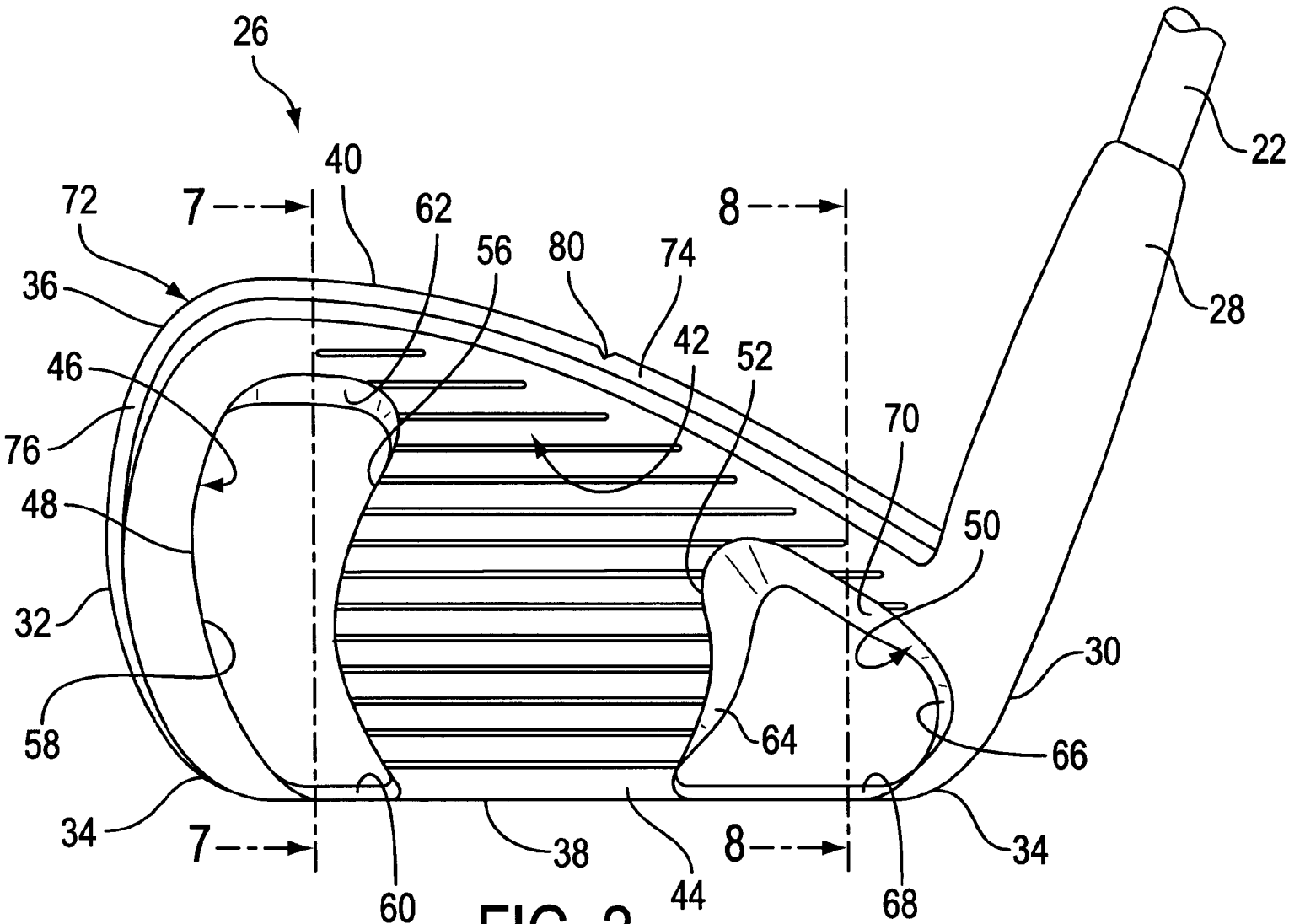
FIG. 2 is a front view showing the club head of FIG. 1 in accordance with certain principles of the invention.
Figure 3:
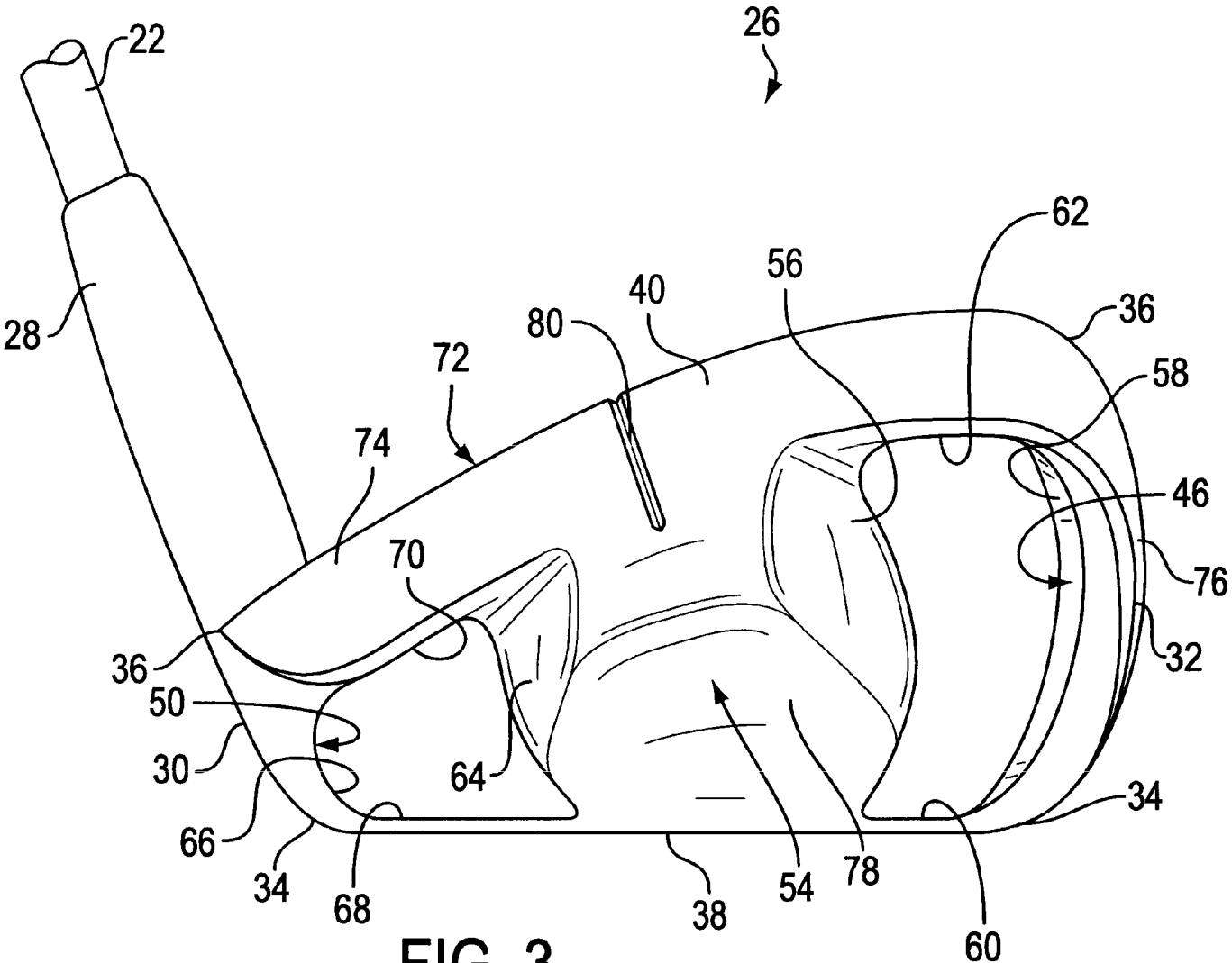
FIG. 3 is a rear view of the club head of FIG. 1 showing the passages with contoured walls, the rear of the sand deflector and a weight mass, all in accordance with certain principles of the invention.

Referring to FIGS. 2 and 3, the side edge 30 is one of a pair of spaced opposed side edges of the head 26, another side edge 32 of the pair being located on the side of the head which is opposite the side edge 30. Each of the side edges 30 and 32 is formed with a first end 34 and a second end 36. The head 26 is further formed with a first linking edge 38 which extends between the first ends 34 of the pair of side edges 30 and 32, and with a second linking edge 40 which extends between the second ends 36 of the pair of side edges.

Figure 8:
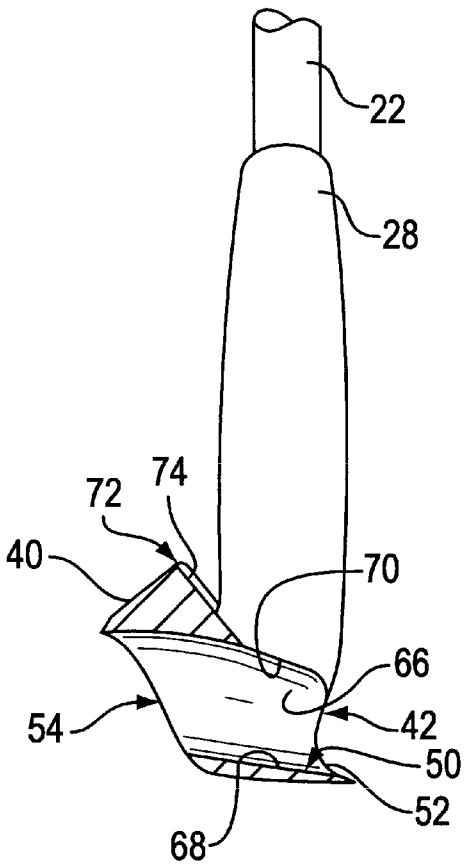
FIG. 8 is a sectional view taken along line 8—8 in FIG. 2 showing features of selected walls of a second of the two passages of FIG. 1 in accordance with certain principles of the invention.
Figure 7:
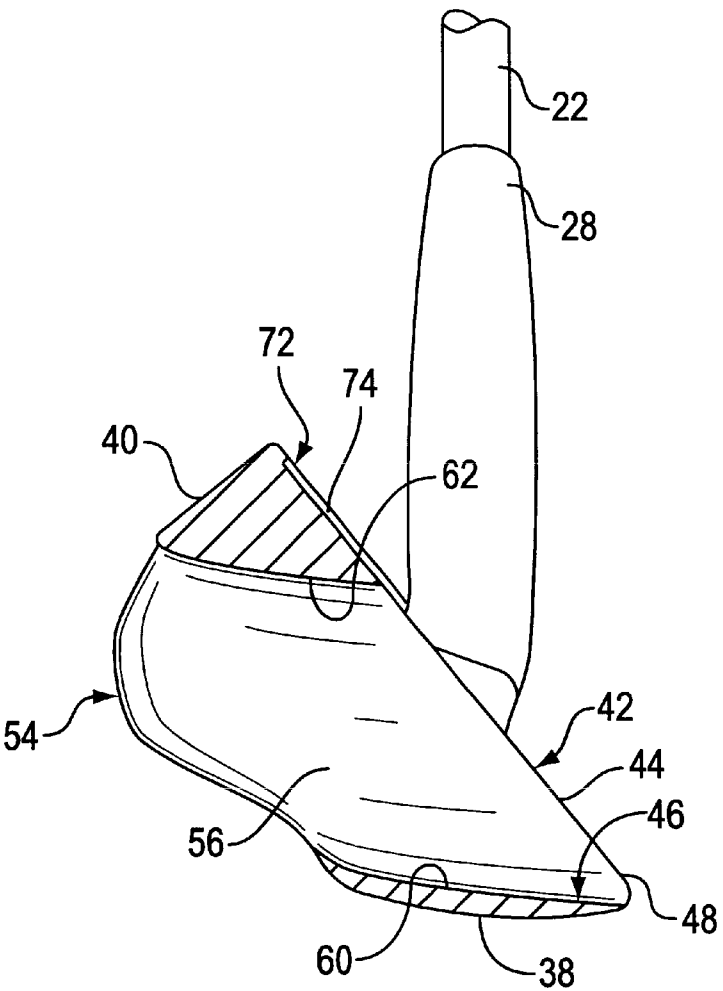
FIG. 7 is a sectional view taken along line 7—7 in FIG. 2 showing features of selected walls of a first of the two passages of FIG. 1 in accordance with certain principles of the invention.

As shown in FIGS. 1, 2, 5 and 7, the head 26 is formed with a front face 42 which includes a ball-impact surface 44. A first passage 46 is formed through the head 26, with an end 48 of the passage located in the front face 42. The first passage 46 is located adjacent the side edge 32, while the end 48 of the first passage is located in a plane of the ball-impact surface 44. A second passage 50 is formed through the head 26, with an end 52 of the second passage located in the front face. The second passage 50 is located adjacent the side edge 30, while the end 52 of the second passage is located in the plane of the ball-impact surface. As shown in FIG. 7, the passage 46 extends through a rear surface 54 of the head 26 and, as shown in FIG. 8, the passage also extends through the rear surface.

Figure 5:
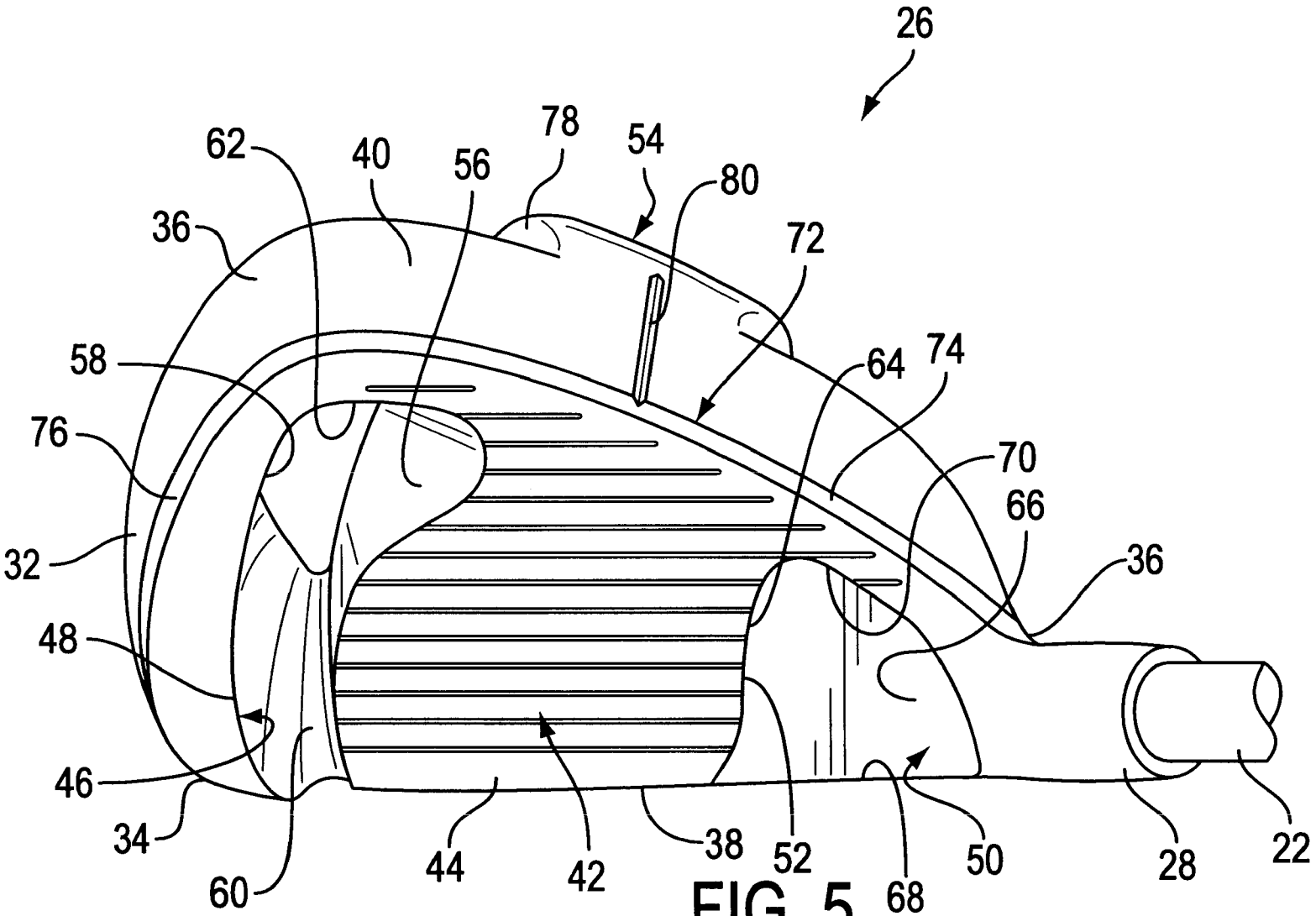
FIG. 5 is a partial front and top view of the head of FIG. 1 showing the passages and the contoured walls of the head, the substantial ball-impact surface, the deflector and the weight mass, all in accordance with certain principles of the invention.

As shown in FIGS. 1, 2 and 5, the ball-impact surface 44 is solid and provides considerable surface area, including the so-called "sweet spot," for firmly striking a golf ball upon the swinging of the club 20 by a golfer. Also, the ball-impact surface 44 is centrally located on the front face 42 between the passages 46 and 50. With respect to the first linking edge 38 and the second linking edge 40, the first linking edge is closest to the ground or sand when the ball is struck by the ball-impact surface 44.

The end 48 of the first passage 46 is formed in a curved fashion between the linking edges 36 and 38 in a concave shape about the adjacent portion of the ball-impact surface 44, and generally continues the concave shape as the first passage extends through the rear face 54, as illustrated in FIG. 3. In a similar arrangement, the end 52 of the second passage 50 is formed in a curved fashion between the linking edges 36 and 38 in a more subdued concave shape about the adjacent portion of the ball-impact surface 44, and generally continues in the concave shape as the second passage extends through the rear face 54, as illustrated in FIG. 3.

As shown in FIGS. 1, 2 and 5, the first passage 46 is formed with spaced side walls 56 and 58 such that the walls at their juncture with the end 48 of the passage are spaced apart by varying widths between a first-edge wall 60 of the first passage, adjacent the linking edge 38, and a second-edge wall 62, adjacent the linking edge 40, of the first passage. The widest portion of the walls 56 and 58, at the end 48 of the passage 46, has a side-to-side portion which extends in a direction between the spaced side edges 30 and 32 of the head 26 and has a prescribed, or first-passage, width dimension which is equal to or greater than the width dimension of any other side-to-side portion at the end of the passage.

As further shown in FIGS. 1, 2 and 5, the second passage 50 is formed with spaced side walls 64 and 66 such that the walls at their juncture with the end 52 of the passage are spaced apart by varying widths between a first-edge wall 68 of the second passage, adjacent the linking edge 38, and a second-edge wall 70, adjacent the linking edge 40, of the second passage. The widest portion of the second passage 50 between the walls 64 and 66, at the end 52, has a side-to-side portion which extends in a direction between the spaced side edges 30 and 32 of the head 26 and has a width dimension, referred to as the second-passage width dimension, which is equal to or greater than the width dimension of any other side-to-side portion at the end of the second passage.

The solid, ball-impact surface 44 extends in a first direction between the linking edges 38 and 40, and in a second direction between the passages 46 and 50, and is formed with varying width dimensions in a direction between the spaced side edges 30 and 32 of the head 26. The varying width dimensions of the ball-impact surface 44 are greater than either the prescribed width dimension of the first passage 46 or the second-passage width dimension of the second passage 50. In addition, the first passage 46 is located between the ball-impact surface 44 and the side edge 32, while the second passage 50 is located between the ball-impact surface and the side edge 30.

As shown in FIG. 7, the first-edge wall 60 and the second-edge wall 62 of the first passage 46 are spaced apart and are slightly angled in a direction from the first linking edge 38 toward the second linking edge 40 as the walls extend from the front face 42 toward the rear face 54. As shown in FIG. 8, the first-edge wall 68 and the second-edge wall 70 of the second passage 50 are spaced apart and are also slightly angled in a direction from the first linking edge 38 toward the second linking edge 40 as the walls extend from the front face 42 toward the rear face 54 of the head 26.

Referring to FIG. 3, the size of the first passage 46 as defined by the side walls 56 and 58, and the size of the second passage as defined by the side walls 64 and 66, each become larger as the passages extend from the front face 42 toward the rear face 54 of the head. This provides for a lateral enlargement of the passages 46 and 50 as the passages extend from the front face 42 toward the rear face 54.

Referring to FIGS. 1, 2 and 5, the head 26 is formed with a hood 72 which extends along, and is located in planes of, the second linking edge 40 and the side edge 32. The hood 72 is contiguous with the front face 42 and extends in cantilever therefrom within the planes of the second linking edge 40 and the side edge 32. The hood 72 is formed with a first section 74 which has portions which are contiguous with the ball-impact surface 44, and other portions which are contiguous with the passages 46 and 50. The hood 72 is further formed with a second section 76 which is contiguous with the front face 42 of the head 26 along the side edge 32. All portions of the first section 74 of the hood 72 extends in cantilever beyond the front face 42 of the head 26 by approximately the same prescribed distance, as does the portions of the second section 76 which are immediately adjacent the juncture of the first section and the second section. The remaining portions of the second section 76 of the hood 72 taper inwardly of the head 26, where the second section eventually blends with the front face 42 of the head 26.

When designing a golf club such as, for example, the sand wedge 20, the weight of the head 26 is an important consideration. Except for a few club head designs of the type shown in the above-noted U.S. Pat. Nos. 780,776; 1,414,124; 4,869,508 and 5,000,455, clubs are typically designed with a solid front face which do not include any passages through the head. Consequently, the mass of such a typical club is located somewhat symmetrically between the front face and the rear face of the head, and thereby provides the appropriate weight for the typically designed club.

Figure 4:
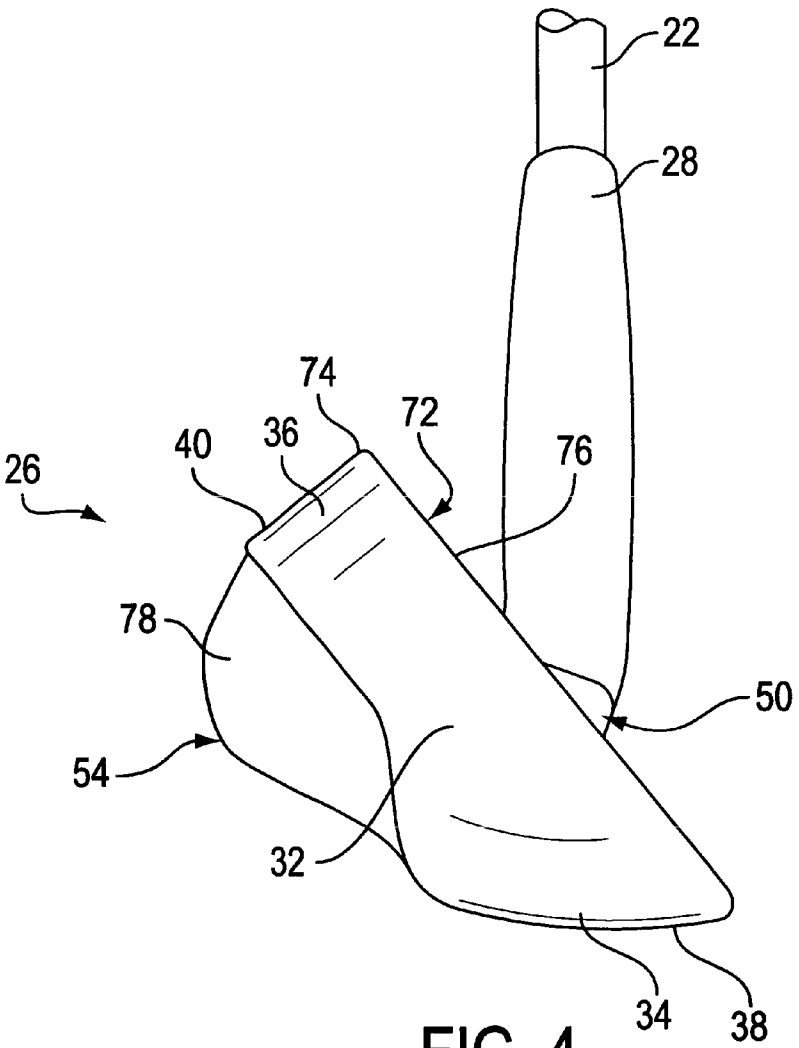
FIG. 4 is an end view of the club head of FIG. 1 showing portions of the sand deflector and the weight mass, all in accordance with certain principles of the invention.
Figure 6:
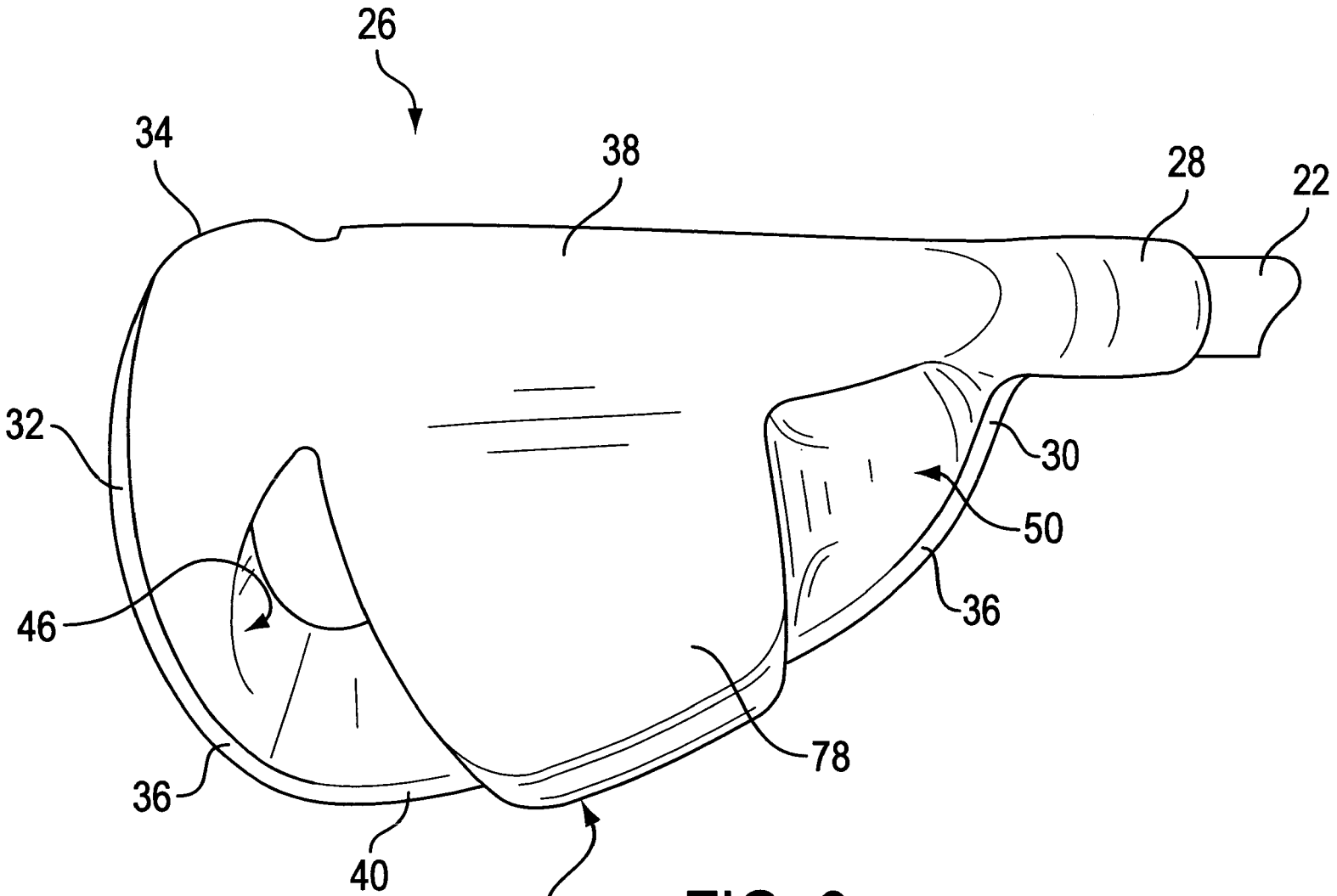
FIG. 6 is a bottom view of the head of FIG. 1 showing the passages and contoured walls thereof and the weight mass, all in accordance with certain principles of the invention.

As shown in FIGS. 1, 2, 3 and 5, and as described above, the golf club, which is represented by the sand wedge 20, is formed with the passages 46 and 50, resulting in an absence of material or mass in a location where such material would typically appear. This results in the sand wedge 20 being of a lower weight compared to the typical club without passages as described above. To compensate for the absence of mass resulting from the placement of the passages 46 and 50, as shown in FIGS. 4 and 6, the rear face 54 of the head 26 is formed with a mass 78 which extends rearward from the ball-impact surface 44. The weight of the mass 78 is approximately the same as the weight of the mass which would normally occupy the openings of the passages 46 and 50 of the head 26.

As shown in FIGS. 3 and 5, a mark 80 is located generally centrally on the second linking edge 40 and the first section 74 of the hood 72, and extends in a direction from the front face 42 toward the rear face 54. In the preferred embodiment, the mark 80 is formed by a "V" shaped groove, but could be formed by any other suitably shaped groove, or by a marker material such as, for example, a stripe of a coating material deposited onto the head 26, all without departing from the spirit and scope of the invention.

The head 26 may be composed of any suitable material such as, for example, steel, aluminum or titanium.

In playing the game of golf, the golf ball occasionally lands in a hazardous areas of the golf course such as, for example, sand, marsh, tall grass and the like. In order to extract the ball from the hazardous lie, the head of the club will frequently encounter resistance from surrounding elements such as, for example, the sand, marsh, tall grass and the like, which is not normally encountered when launching the ball from other, non-hazardous locations of the course.

To assist the golfer in this situation, a special club is frequently used. One example of such a club is a sand wedge, which typically is formed with a solid front face at a drastic loft angle. The drastic loft angle allows the golfer to direct the front face somewhat under the ball and lift the ball from the hazardous lie while, at the same time, launching the ball toward its desirable destination, the pin.

Even though the drastically angled, solid front face of the head assists the golfer in extracting the ball from the hazard, the solid front face will, as noted above, encounter resistance to the movement of the head during the swinging thereof. An attempt by the golfer to compensate for this resistance could affect the effort to successfully extract the ball from the hazard, thereby possibly resulting in an errant trajectory or shortened travel of the ball.

The normally-encountered resistance, described above, can be lessened significantly by use of the above-described club, such as the sand wedge 20, which also includes other structural features helpful to the golfer. For example, when using the sand wedge 20, the golfer aligns the mark 80 of the sand wedge head 26 with a golf ball, which is resting in the sand of a trap, in a manner conventionally followed by the golfer. This insures that the golfer has aligned the ball with the ball-impact surface 44, which is formed with a fully ample, unfettered surface for striking the ball. The sand wedge 20 is moved through the back swing in a conventional manner and is then swung toward its impact destination with the ball.

As described above, the front face 42 of the head 26 of the sand wedge 20 is formed with the ball-impact surface 44, which has a width dimension greater than the prescribed width dimension of the passage 46, and greater than the width of the passage 50. This provides the golfer with an amply-sized, solid, ball-impact surface to insure that the ball will be struck by a solid surface, as compared to club heads having slots or perforations formed through the front face thereof.

As noted above, the mass 78 at the rear face 54 of the head 26 has a weight comparable to the weight of a mass which is equal to the volume occupied by the passages 46 and 50. Thus, during the swinging of the sand wedge 20, and from a weight consideration, the golfer does not experience any significant difference between the feel of the sand wedge 20 and the feel of a sand wedge formed without any passages.

As the head 26 of the sand wedge 20 engages the sand of the trap, some of the sand will pass through the passages 46 and 50, thereby lessening the resistance introduced by the sand, in comparison to a fully, solid front-faced club having no passages through the head.

The movement of the sand through the passages 46 and 50 is further enhanced by the contours of the passages extending to the rear face of the head 26. For example, the walls 60 and 62 of the passage 46, and the walls 68 and 70 of the passage 50, are formed at the slight angle noted above to facilitate the movement of the sand through the passages. Also, the spreading apart of the side walls 56 and 58 of the passage 46, and the side walls 64 and 66 of the passage 50, as the passages extend from the front face 42 toward the rear face 54, further enhances the movement of the sand through the passages. Thus, the contours of the walls of the passages 46 and 50 also lessen the resistance presented by the sand by facilitating rapid movement of the sand therethrough, and precluding any clogging of the passages by the sand.

As a head of a sand wedge passes through the sand, and is raised in the follow-through portion of the swinging action, sand may collect on the front face of the head and could be dispersed through the surrounding atmosphere to the annoyance of the golfer and those nearby. The head 26 of the sand wedge 20 is formed with the hood 72 which is strategically located, as described above, to preclude and/or deflect disbursement of at least a significant portion of any sand collected on the front face 42 of the head.

The above-described features of the sand wedge 20 can be incorporated, where desired, into other clubs typically used in the playing of golf without departing from the spirit and scope of the invention.

In general, the above-identified embodiments are not to be construed as limiting the breadth of the present invention. Modifications, and other alternative constructions, will be apparent which are within the spirit and scope of the invention as defined in the appended claims.

What is claimed is:

1. A golf club, which comprises:

a shaft;

a head attached to one end of the shaft;

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a first passage formed through the head adjacent a first of the pair of side edges with an end of the first passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the first passage being located between the ball-impact surface and the first of the pair of side edges of the head;

a second passage formed through the head with an end of the second passage located in the front face of the head;

the second passage being located adjacent a second of the pair of side edges; and the ball-impact surface being located between the first and second passages.

2. The golf club as set forth in claim 1, which further comprises:

the end of the second passage being formed with at least a side-to-side portion which extends in the direction between the spaced side edges of the head having a second-end width dimension which is equal to or greater than the width of any other side-to-side portion of the end of the second passage; and the second-end width dimension being less than the width dimension of the ball-impact surface.

3. The golf club as set forth in claim 1, which further comprises:

a hosel being formed on the head and extending from one of the pair of side edges.

4. A gulf club, as set forth in claim 1, wherein the second linking edge is an edge of the head which is farthest from the ground or sand when the ball is struck by the ball-impact surface of a club being swung; which comprises:

a shaft;

a head attached to one end of the shaft;

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a passage formed through the head with an end of the passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the passage being located between the ball-impact surface and one of the side edges of the head;

the second linking edge being an edge of the head which is farthest from the ground or sand when the ball is struck by the ball-impact surface of a club being swung; and a hood formed on the front face of the head contiguous with a plane of the ball-impact surface and extending in cantilever therefrom within a plane of the second linking edge.

5. The golf club as set forth in claim 4, which further comprises:

the hood being contiguous with at least the ball-impact surface.

6. The golf club as set forth in claim 4, which further comprises:

the hood being contiguous with at least the passage.

7. The golf club as set forth in claim 1, which further comprises:

the head being composed of a prescribed material;

the head being formed with a rear face located on a side of the head opposite the front face; and a mass of material formed on the rear face to provide a weight of the head which is substantially the same as the weight of a comparable head which is formed without the passage.

8. The golf club as set forth in claim 1, wherein the second linking edge is an edge of the head which is farthest from the ground or sand when the ball is struck by the ball-impact surface of a club being swung; and which further comprises:

a mark formed on the second linking edge to facilitate the location of the club for visual alignment of the ball-impact surface with a ball to be launched by a golfer using the golf club.

9. A golf club, which comprises:

a shaft;

a head attached to one end of the shaft;

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a passage formed through the head with an end of the passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension; and the end of the passage being located between the ball-impact surface and one of the side edges of the head;

the first linking edge being an edge of the head which is closest to the ground or sand when the ball is struck by the ball-impact surface of a club being swung;

the head being formed with a rear face through which the passage is formed;

the passage formed with a first-edge wall adjacent the first linking edge and a second-edge wall adjacent the second linking edge and spaced from the first-edge wall; and the first-edge and second-edge walls extending from the front face to the rear face of the head and angled from the first linking edge at the front face in a direction toward the second linking edge at the rear face.

10. A golf club, which comprises:

a shaft;

a head attached to one end of the shaft;

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a passage formed through the head with an end of the passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the passage being located between the ball-impact surface and one of the side edges of the head;

the head formed with a rear face on a side thereof opposite the front face;

the passage extending from the end thereof at the front face toward the rear face; and the passage formed with spaced side walls which become spaced farther apart as the passage extends from the front face toward the rear face of the head.

11. A head for a golf club, which comprises:

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a first passage formed through the head adjacent a first of the pair of side edges with an end of the first passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the first passage being located between the ball-impact surface and the first of the pair of side edges of the head;

a second passage formed through the head with an end of the second passage located in the front face of the head;

the second passage being located adjacent a second of the pair of side edges; and the ball-impact surface being located between the first and second passages.

12. The head as set forth in claim 11, which further comprises:

the end of the second passage being formed with at least a side-to-side portion which extends in the direction between the spaced side edges of the head having a second-end width dimension which is equal to or greater than the width of any other side-to-side portion of the end of the second passage; and the second-end width dimension being less than the width dimension of the ball-impact surface.

13. A head for a golf club; which comprises:

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a passage formed through the head with an end of the passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension; and the end of the passage being located between the ball-impact surface and one of the side edges of the head;

the first linking edge is an edge of the head which is closest to the ground or sand when the ball is struck by the ball-impact surface of a club being swung;

the head being formed with a rear face through which the passage is formed;

the passage formed with a first-edge wall adjacent the first linking edge and a second-edge wall adjacent the second linking edge and spaced from the first-edge wall; and the first-edge and second-edge walls extending from the front face to the rear face of the head and angled from the first linking edge at the front face in a direction toward the second linking edge at the rear face.

14. A head for a golf club, which comprises:

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a passage formed through the head with an end of the passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the passage being located between the ball-impact surface and one of the side edges of the head;

the head formed with a rear face on a side thereof opposite the front face;

the passage extending from the end thereof at the front face toward the rear face; and the passage formed with spaced side walls which become spaced farther apart as the passage extends from the front face toward the rear face of the head.

15. A head for a sand wedge, which comprises:

a hosel;

the head formed with a ball-impact surface on a front face thereof;

the head formed with a first side edge, and a second side edge adjacent the hosel and spaced from and on a side of the front surface opposite from the first side edge, with each side edge having a first end and a second end;

the head formed with a first linking edge extending between the first ends of the first and second side edges, and a second linking edge extending between the hosel and the second end of the first side edge in a spaced, opposed relation to the first linking edge; and a hood formed on the front face of the head contiguous with a plane of the ball-impact surface and extending in continuous cantilever from the second linking edge and from the first side edge.

16. The head as set forth in claim 15, which further comprises:

the hood being contiguous with at least the ball-impact surface.

17. The head as set forth in claim 15, which further comprises:

a passage formed in the front face of the head adjacent the ball-impact surface; and the hood being contiguous with at least the passage.

18. The head as set forth in claim 15, which further comprises:

the head formed with a first passage through the front face adjacent a first of the pair of side edges;

the head formed with a second passage through the front face adjacent a second of the pair of side edges;

the hood being contiguous with the first and second passages and the ball-impact surface.

19. The head as set forth in claim 15, which comprises:

a passage formed through the head from the front face to a rear face thereof;

the head being composed of a prescribed material; and a mass of material formed on the rear face to provide a weight of the head which is substantially the same as the weight of a comparable head which is formed without the passage.

20. A head for a sand wedge, which comprises:

the head formed with a ball-impact surface on a front face thereof;

the head formed with a pair of spaced, opposed side edges with each side edge having a first end and a second end;

the head formed with a first linking edge extending between the first ends of the side edges, and a second linking edge extending between the second ends of the side edges in a spaced, opposed relation to the first linking edge;

a first passage formed through the head adjacent a first of the pair of side edges with an end of the first passage located in the front face of the head;

at least a side-to-side portion of the end of the passage which extends in a direction between the spaced side edges of the head having a prescribed width dimension which is equal to or greater than the width of any other side-to-side portion of the end of the passage;

the ball-impact surface being solid and formed with a side-to-side portion, which extends in a direction between the spaced side edges of the head, having a width dimension which is greater than the prescribed width dimension;

the end of the first passage being located between the ball-impact surface and the first of the pair of side edges of the head;

a second passage formed through the head with an end of the second passage located in the front face of the head;

the second passage being located adjacent a second of the pair of side edges; and the ball-impact surface being located between the first and second passages;

the second linking edge being an edge of the head which is farthest from the ground or sand when the ball is struck by the ball-impact surface of a club being swung; and a hood formed on the front face of the head contiguous with a plane of the ball-impact surface and extending in cantilever therefrom within a plane of the second linking edge.

21. The head as set forth in claim 20, which further comprises:

the hood being contiguous with at least the ball-impact surface.

22. The head as set forth in claim 20, which further comprises:

the hood being contiguous with at least the passage.

23. The head as set forth in claim 15, which further comprises:

at least portions of the continuous cantilever of the hood extend from the second linking edge and the first side edge by the same prescribed distance.

24. The head as set forth in claim 15, which further comprises:

at least a portion of the continuous cantilever of the hood, which extends from the first side edge, tapers toward the front face of the head adjacent the first end thereof.

25. A head for a sand wedge, which comprises:

a hosel;

the head formed with a single ball-impact surface on a front face thereof;

the head formed with a first side edge, and a second side edge adjacent the hosel and spaced from and on a side of the front surface opposite from the first side edge, with each side edge having a first end and a second end;

the head formed with a first linking edge extending between the first ends of the first and second side edges, and a second linking edge extending between the hosel and the second end of the first side edge in a spaced, opposed relation to the first linking edge; and a hood formed on the front face of the head contiguous with a plane of the single ball-impact surface and extending along a length thereof in continuous cantilever from the second linking edge at a prescribed distance from the front face along at least a continuous portion of the length of the second linking edge.

* * * * *